US006988565B2

(12) United States Patent
Giardino

(10) Patent No.: US 6,988,565 B2
(45) Date of Patent: Jan. 24, 2006

(54) RETROFIT KIT FOR A MODULAR CONTROL APPARATUS FOR A POWER IMPACT TOOL

(75) Inventor: David A. Giardino, Rock Hill, SC (US)

(73) Assignee: Chicago Pneumatic Tool Company, Rock Hill, SC (US)

( * ) Notice: Subject to any disclaimer, the term of this patent is extended or adjusted under 35 U.S.C. 154(b) by 0 days.

(21) Appl. No.: 10/191,328

(22) Filed: Jul. 9, 2002

(65) Prior Publication Data

US 2004/0007370 A1 Jan. 15, 2004

(51) Int. Cl.
*B25D 9/00* (2006.01)
*B25B 23/14* (2006.01)

(52) U.S. Cl. ..... 173/176; 173/93; 173/168; 173/218

(58) Field of Classification Search ..... 173/176, 173/180, 178, 179, 1, 937, 138, 177, 218, 173/78, 93.5, 93, 93.7, 168, 169
See application file for complete search history.

(56) References Cited

U.S. PATENT DOCUMENTS 2,727,598 A * 12/1955 Mitchell et al. ..... 173/178
3,162,250 A * 12/1964 Sindelar ..... 173/176
3,406,762 A * 10/1968 Kramer ..... 173/176
3,578,091 A * 5/1971 States ..... 173/176
3,643,749 A * 2/1972 Pauley ..... 173/176
3,703,993 A * 11/1972 Schoeps ..... 173/178
4,562,389 A * 12/1985 Jundt et al. ..... 173/176
4,729,436 A * 3/1988 Amador et al. ..... 173/179
5,082,066 A * 1/1992 Schoeps ..... 173/178
5,181,575 A * 1/1993 Maruyama et al. ..... 173/180
5,315,501 A * 5/1994 Whitehouse ..... 173/180
5,492,185 A * 2/1996 Schoeps et al. ..... 173/176
5,544,710 A * 8/1996 Groshans et al. ..... 173/176
5,715,894 A * 2/1998 Maruyama et al. ..... 173/180
6,155,355 A * 12/2000 Holmin ..... 173/176
6,378,623 B2 * 4/2002 Kawarai ..... 173/180
6,765,357 B2 * 7/2004 Cripe et al. ..... 173/176

* cited by examiner

*Primary Examiner*—Scott A. Smith
(74) *Attorney, Agent, or Firm*—Schmeiser, Olsen & Watts

(57) ABSTRACT

The invention comprises retrofit kits for power impact tools. The retrofit kits adapt modular control apparatuses to power impact tools that where not originally manufactured to receive a modular control apparatuses. The retrofit kits comprise a modular control apparatus and at least one fastener. The modular control apparatus may be specially manufactured to adapt retrofit tools or an adapter may be included in the kit. Adapters intercept the energy flow to the motor of the tool and re-channels the energy flow through a modular control apparatus, which then controls the flow of energy to the motor. The retrofit kit may include instruction sheets describing and illustrating the methods of using the retrofit kit.

13 Claims, 6 Drawing Sheets

RETROFIT KIT FOR A MODULAR CONTROL APPARATUS FOR A POWER IMPACT TOOL

FIELD OF INVENTION

This invention relates generally to the field of power impact tools and, more particularly, to retrofitting a modular control apparatus to a power impact tool and more specifically to retrofitting timing devices to power impact tools.

BACKGROUND OF INVENTION

Power impact tools (e.g., pneumatic, hydraulic, electric, etc.) are well known in the art. Power impact tools produce forces on a workpiece by the repeated impact of a motor-driven hammer on an anvil that is mechanically connected, directly or indirectly, to exert a force on the workpiece. Some power impact tools exert linear forces. Other power impact tools exert torque, which is a twisting force.

One difficulty in current power impact tools is that power may be applied too long to the workpiece. The accumulation of impacts on any already tightened workpiece may cause damage. Current power impact tools shut off when the operator manually enables shutting off. For example, in a pneumatic hand tool such as a torque wrench, the operator releases the trigger valve to shut off the supply of compressed air to the tool motor. The number of impact forces delivered to the workpiece depends on the reflexes and attentiveness of the tool operator. During any delay, the workpiece may become overtorqued and damaged.

Applicant's co-pending application Ser. No. 10/213,702, discloses, among other things, a modular control apparatus. One modular control apparatus, a torque-timing device, is operative to limit the amount of time that torque will be applied after the operator initiates torque production from a power impact tool. For example, the operator may squeeze the trigger of a power impact torque wrench to initiate torque production. The modular torque-timing device is configured to be used with a particular family of power impact tools. It is desired to enable operators to use the modular torque-timing device with tools that were not originally manufactured to interface with a modular torque-timing device. Similarly, it is desirable to enable operators to use other modular control apparatuses with tools that were not originally manufactured to interface with a modular control apparatus.

Accordingly, there is a need in the field of power impact tools for an after-market product to provide more control of forces ultimately applied to a workpiece by a power impact tool.

SUMMARY OF INVENTION

The invention comprises retrofit kits for power impact tools. The retrofit kits adapt modular control apparatuses to power impact tools that where not originally manufactured to receive modular control apparatuses. The retrofit kits each comprise a modular control apparatus and at least one fastener. The modular control apparatus may be specially manufactured to adapt to retrofit tools or an adapter may be included in the kit. Adapters intercept the energy flow to the motor of the tool and re-channels the energy flow through a modular control apparatus, which then controls the flow of energy to the motor. Adapters also provide a mechanical interface between the tool and the modular control apparatus. The energy flow may be intercepted internally or externally to the tool. The retrofit kit may include instruction sheets describing and illustrating the methods of using the retrofit kit.

An first general aspect of the invention provides a kit comprising:

a modular control apparatus; and an adapter.

A second general aspect of the invention provides a kit comprising:

a modular control apparatus; and an adapter.

A third general aspect of the invention provides a kit comprising:

an adapter..

A fourth general aspect of the invention provides a kit comprising:

a modular control apparatus; and an adapter, the adapter comprising a plurality of parts.

A fifth general aspect of the invention provides a kit comprising:

an adapter, the adapter comprising a plurality of parts.

A sixth general aspect of the invention provides a kit comprising:

at least one modular control apparatus;

an adapter, the adapter comprising at least one part; and housing panels;

A sixth general aspect of the invention provides a kit comprising:

at least one modular control apparatus;

an adapter, the adapter comprising at least one part;

housing panels; and at least one fastener.

The foregoing and other features of the invention will be apparent from the following more particular description of various embodiments of the invention.

BRIEF DESCRIPTION OF DRAWINGS

Some of the embodiments of this invention will be described in detail, with reference to the following figures, wherein like designations denote like members, wherein.

DETAILED DESCRIPTION OF THE INVENTION

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. Although the drawings are intended to illustrate the present invention, the drawings are not necessarily drawn to scale.

Figure 1B:
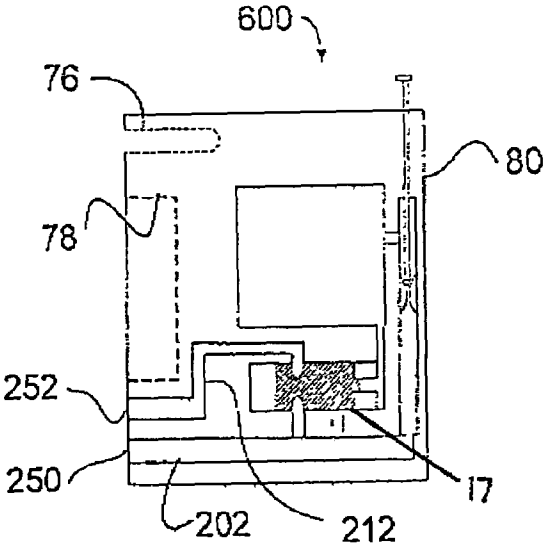
FIG. 1B depicts a cross-sectional view of an embodiment of a modular, releasably-attachable, user-adjustable, control apparatus, in accordance with an embodiment of the present invention.

A particular modular control apparatus is used with, or as part of, a power impact tool and, in particular embodiments, allows for time-limiting the torque output. Power impact tools can include various power (e.g., pneumatic, hydraulic, electric, etc.) impact tools. The exemplary my modular control apparatus shown herein; represents a modular control apparatus including a torque limiting timing device 17 (as shown in FIG. 1B) that when used with a power impact tool, for example with a pneumatic impact tool, provides a fixed duration of torque from the air motor within the tool, to a workpiece, such as a nut or bolt.

A motor, as defined and used herein, is any device for converting a first energy into kinetic energy. For example, an air motor converts the energy of an expanding compressed gas into the rotational motion of a mechanical drive shaft. For another example, an electric motor converts electricity into the rotational motion of a mechanical drive shaft. For yet another example, the drive piston and valves of a jack hammer form a motor to convert the energy of an expanding compressed fluid into linear motion of a mechanical drive shaft. For a final example, a hydraulic motor converts the kinetic energy of a flowing, slightly compressible fluid (hydraulic fluid) into the rotational motion of a mechanical drive shaft. The drive shaft, in each embodiment, is rotated by the motor, and tools, for operating on work pieces (workpiece adapters) are mechanically connected directly or indirectly between the drive shaft and the work piece.

Figure 1A:
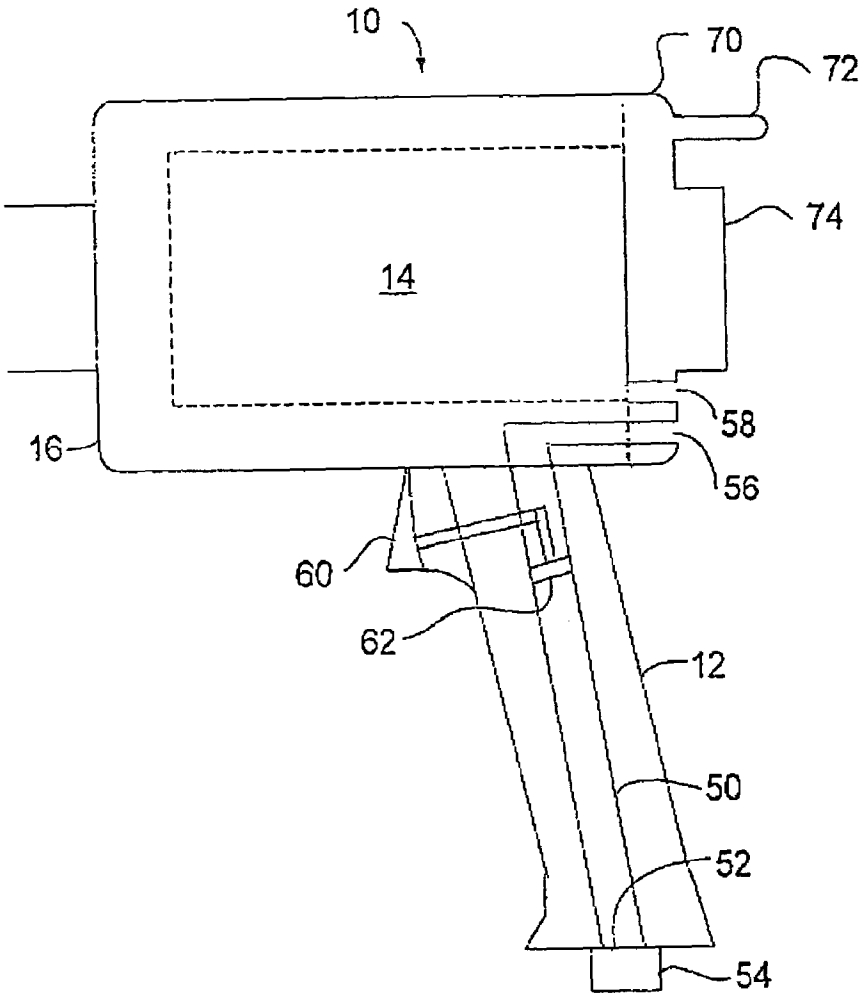
FIG. 1A depicts a cross-sectional view of an embodiment of a power impact tool adapted to receive a modular, releasably-attachable control apparatus, in accordance with an embodiment of the present invention.

Referring now to FIG. 1A, an embodiment of a power impact tool 10 is shown in a vertical section through the centerline of the tool 10. The tool 10 has a handle 12 containing a channel 50 for receiving a compressible fluid through a port 52 at the base of the handle 12. A channel comprises a confined path for the flow of a compressible fluid. Channels may be pipes, hoses, bores formed in a block of material, or similar flow constraints. Channels may include couplings. In some particular embodiments, channels may include a valve. The tool 10 also has a housing 16 which covers the motor 14 and other moving parts to protect the operator. The housing 16 conventionally comprises a plurality of housing sections or panels.

A compressible fluid, as defined and used herein, is a fluid with a bulk modulus that is less than the bulk modulus of water. Compressible fluids with low bulk moduli transfer energy by converting the potential energy of their compressed state into the kinetic energy of an expanding fluid and then into the kinetic energy of a motor rotor. Elemental gases, such as helium and nitrogen, and mixed gases such as air, are compressible fluids with low bulk moduli. Slightly compressible fluids have high bulk moduli and are used for force transmission. Hydraulic fluids, for example, typically have higher bulk moduli. Either type of compressible fluid can transfer energy into a motor.

The port 52 is equipped with a fitting 54 for connecting to a supply of compressed fluid. A supply of compressible fluid may be, for example, a hose supplying compressed air such as is used in an auto repair shop to power pneumatic tools. Within the channel 50 is a manually operated valve 62, shown in FIG. 1A as a trigger valve 62, which enables the tool-user to initiate the flow of compressible fluid through the channel 50. By depressing the trigger 60, the valve 62 is opened, thereby channeling the compressible fluid toward a motor 14 of the tool 10. To reach the motor 14, the compressible fluid must be channeled from port 56 to port 58. This may be accomplished by attaching the modular control apparatus 600 or by attaching an end cap of the housing (not shown) which connects port 56 to port 58. The channel 50 extends to a backplate 70 of the tool where the channel 50 terminates at a port 56 sized and shaped to receive (see FIG. 1B) a corresponding port 250 to a first channel 202 in an exemplary modular control apparatus 600. Thus, the first channel 202 is the input channel to the modular control apparatus 600.

A modular control apparatus 600 is a first apparatus that controls at least one function of at least one second apparatus. A modular control apparatus 600 is modular in that it may be manipulated as a single physical unit (a module). The module comprises a generally solid block, or body, within which are formed the mechanisms which implement control functions. The body may be created from a single block or may be built up from a plurality of sub-blocks. The modular control apparatus 600 may be manipulated into a relationship with a second apparatus in which interaction between the modular control apparatus 600 and a second apparatus results in a change in the operation of the second apparatus. For some examples in the field of pneumatics, a modular control apparatus 600 may shut off air flow to a tool 10 (a second apparatus) after a user-selected time, may oscillate the direction of air flow, as in a jack hammer, or may change the pressure of the air entering the second apparatus.

The exemplary modular control apparatus 600 is configured to be releasably attachable to the tool 10. The apparatus is releasably attachable when the connections between the modular control apparatus 600 and the tool 10 can be opened and closed by the tool user. The connectors may be bolts, clamps, latches, locks, or similar devices known in the art. In an embodiment, the connections can all be opened or all be closed by a single motion of the user's hand. For example, a lever-activated connector may be opened by operation of the lever.

Located on the backplate 70 is a port 58 sized and shaped to receive the compressed fluid which is discharged from an output port 252 ( FIG. 1B) of a second channel 212 of the modular control apparatus 600. The second channel is the output channel. The backplate 70 may be, for example, the backplate 70 of a Model 749 pneumatic torque wrench made by Chicago Pneumatic Tool. In an embodiment, the backplate 70 has a cylindrical protrusion 74, perhaps accommodating a motor bearing within, which is used as an alignment mechanism for aligning the modular control apparatus 600 to the tool 10.

Figure 2B:
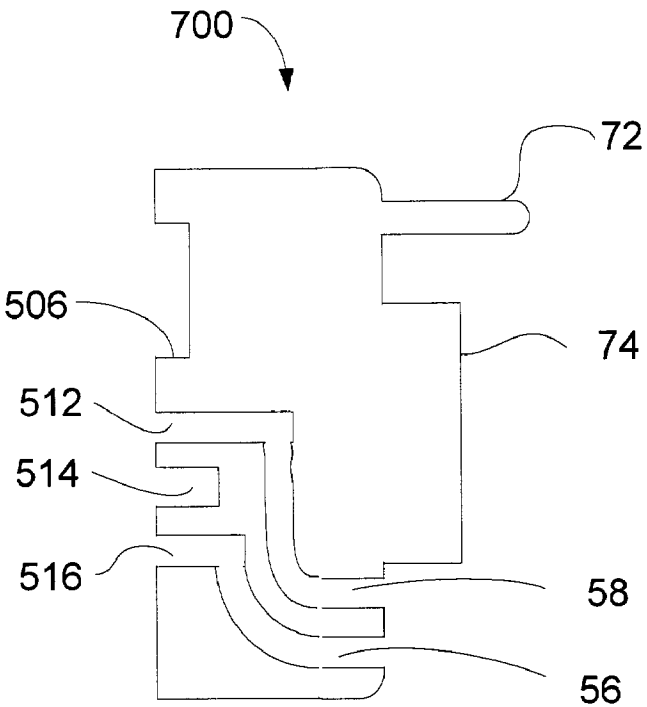
FIG. 2B depicts a cross-sectional view of an alternative embodiment of an adapter plate in accordance with an embodiment of the present invention.
Figure 2A:
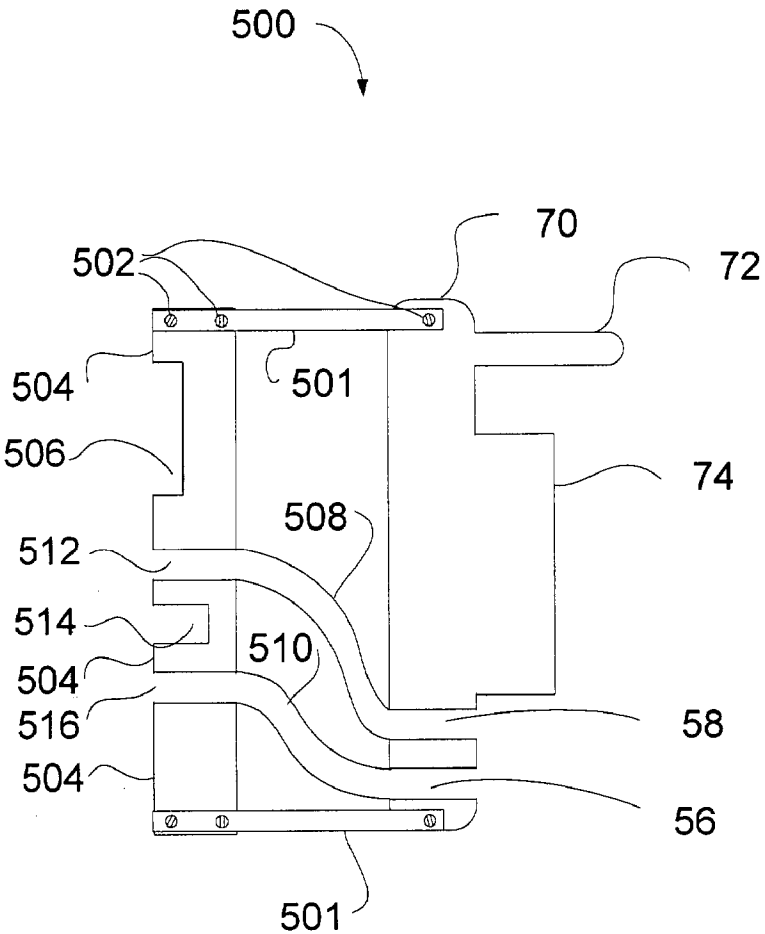
FIG. 2A depicts a cross-sectional view of an embodiment of an adapter plate in accordance with an embodiment of the present invention.
Figure 4:
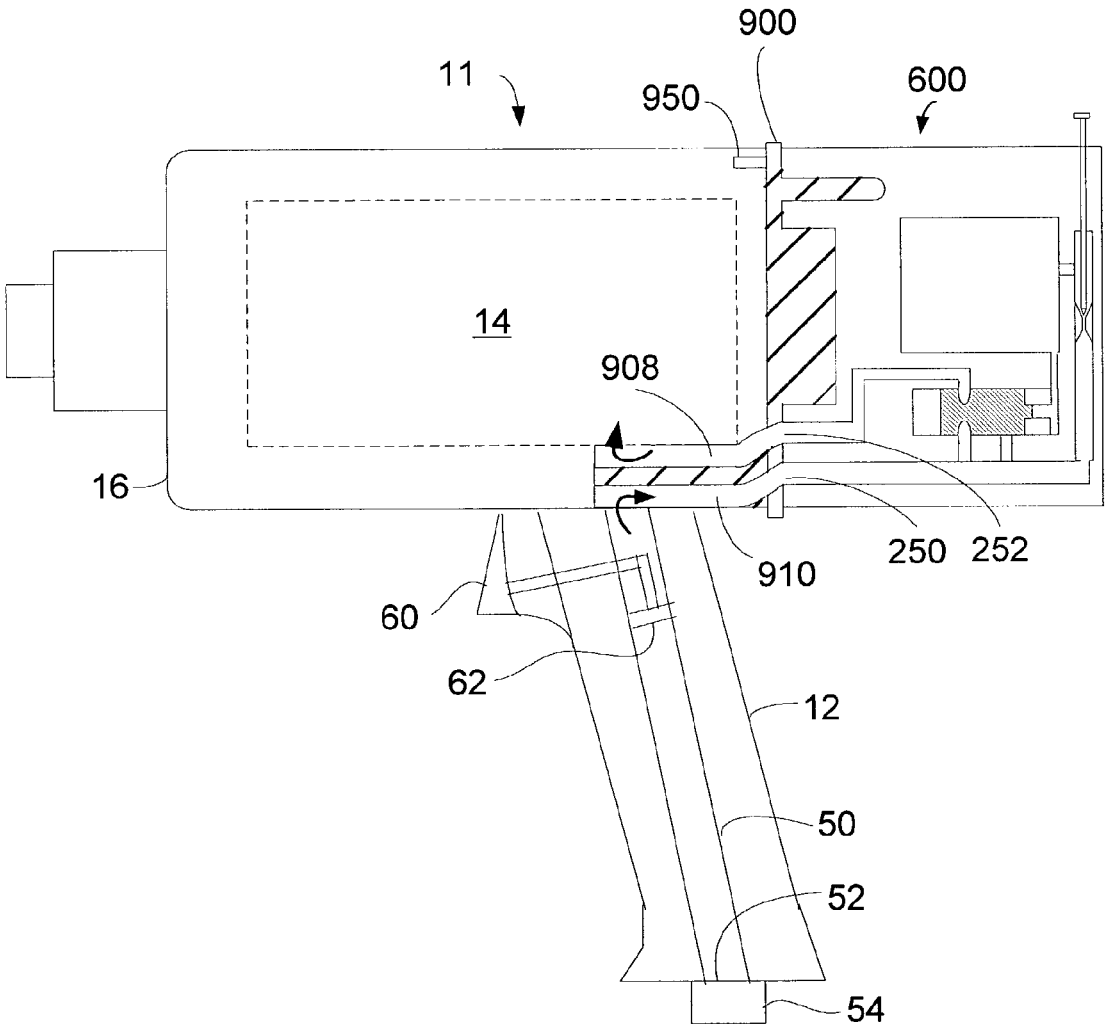
FIG. 4 depicts an example of an embodiment of a modular control apparatus connected to an adapter which intercepts an energy flow between a handle and a motor of a tool.

For a retrofit tool 11 (FIG. 4) which is not designed to receive a modular control apparatus, the backplate 70 may receive an adapter 500 or 700 (FIGS. 2A and 2B) which provides an interface between the retrofit tool 11 and the modular control apparatus 600. Refer now to FIGS. 2A and 2B. In such retrofit cases, adapters 500 and 700 may be designed for each uniquely designed retrofit tool 11. On the modular control apparatus-receiving side of the adapters 500 and 700 (the right-hand side in FIGS. 2A and 2B), at least a portion of the adapter may be configured like the backplate 70 of a tool 10 (FIG. 1) for which the modular control apparatus 600 was originally designed. On the retrofit-tool-receiving side (the lefthand side in FIGS. 2A and 2B), the at least a portion of the adapter 500 or 700 may be configured like a backplate 504 of the retrofit tool 11. Remaining portions of the adapter 500 provide two channels for compressible fluids: a first adapter channel 510 between the compressible fluid supply 516 and the adapter output port 56 which couples with the input port 250 of the modular control apparatus 600. A second adapter channel 508 receives compressible fluid from the discharge port 252 of the modular control apparatus 600 through coupled port 58 and channels the compressible fluid to the retrofit tool 11 and there through to its motor 14 (FIG. 4). The adapter 500 and 700 also provides sufficient structure 70 and 790 and attachment mechanisms for securing the adapter 500 or 700 to the retrofit tool 11 and to the modular control apparatus 600.

Referring again to FIGS. 1A and 1B, the alignment mechanisms 72, 74, 76, and 78 comprise passive means to ensure that the input port 250 and discharge port 252 of the modular control apparatus 600 mate sealingly with the fluid supply port 56 and the motor inlet port 58 of the tool 10, respectively. In an embodiment, the backplate 70 of the tool 10 has a cylindrical extension 74 that fits into a corresponding recess 78 in the modular control apparatus 600. The backplate 70 is further equipped with at least one asymmetrically arranged rod 72 corresponding to at least one hole 76 in the modular control apparatus 600. The rods 72 are arranged asymmetrically so that there is only one orientation of the modular control apparatus 600 that will allow the apparatus 600 to be received onto the tool 10. That orientation is the orientation at which the ports of the apparatus 250 and 252 and the tool will line up properly. The attachment mechanism may be as simple as a bolt through the modular control apparatus into a threaded hole in the tool. Those skilled in the art of tool manufacture will be aware of many different ways of making the attachment. The requirements for the attachment mechanism are that it create a seal against leakage of the compressible fluid and that it be reusable.

It is desirable to adapt the modular control apparatus 600 to tools 11 (FIG. 4) that were not originally designed to receive it. There are two basic approaches to accomplishing this. In some embodiments, a modular control apparatus 600 that is unique to each retrofit tool 11 may be designed. This approach loses economies of scale in the production of the modular control apparatus 600. In other embodiments, adapter kits may be provided. Adapter kits provide means to adapt a modular control apparatus to a tool not originally manufactured to receive the modular control apparatus 600, which will be referred to as a "retrofit tool" 11 (FIG. 4). Consider three approaches to adapting a modular control apparatus 600 to a retrofit tool 11.

A retrofit kit may comprise a modular control apparatus 600 uniquely designed for the retrofit tool 11 and fasteners. A retrofit kit is formed when all of its parts are delivered to a common destination.

First, in cases where a backplate 310 (FIG. 3A) of a retrofit tool 11 provides access to the compressible fluid supply to the motor, an adapter may be made to interface with the modular control apparatus 600 to attach the modular control apparatus 600 behind the motor 14 (FIG. 1A) to a backplate of the retrofit tool 11. Referring to FIG. 2A, an adapter 500 comprising at least a portion of a backplate 504 of a retrofit tool 11 may be formed by mechanically connecting a backplate 70, designed to receive the modular control apparatus 600 (FIG. 1B), with a backplate 504 of a retrofit tool 11. The mechanical connection may be by means of girders 501 connected by bolts 502. In other embodiments, the mechanical connection may be by plates, shells, bolts, or any other means of maintaining a substantially rigid connection between the back plates 70 and 504. Channel 510 connects the compressible fluid supply port 56 of back plate 70 with the supply port 516 of backplate 504. Channel 508 connects motor inlet port 58 of backplate 70 with motor inlet port 512 of backplate 504. Backplate 504 may have alignment recesses 514 and 506 as well as attachment mechanisms (not shown) for attaching to the retrofit tool 11 for which it is designed.

Referring to FIG. 2B, in an embodiment, the adapter may be formed as at least one piece 700 with the tool-receiving features 506–516 of a retrofit tool's 11 backplate 310 (FIG. 3A) and features 56, 58, 72, and 74 for receiving the modular control apparatus 600.

A retrofit kit for an embodiment of FIGS. 2A–B comprises an adapter 500 or 700, a modular control apparatus 600, and fasteners and couplings (not shown) adapted to the specific designs.

Figure 3C:
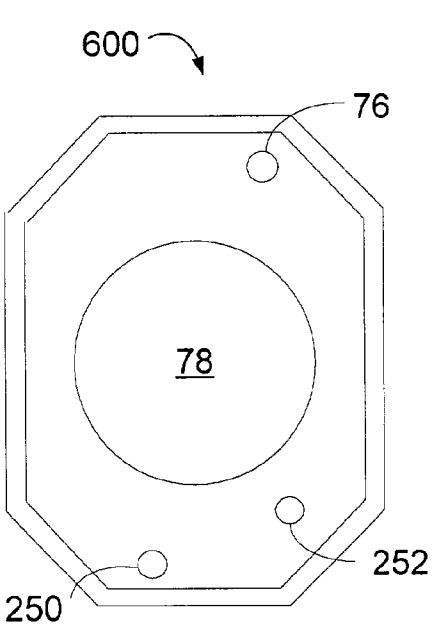
FIG. 3C depicts an interface surface of a modular control apparatus aligned to FIG. 3B.
Figure 3B:
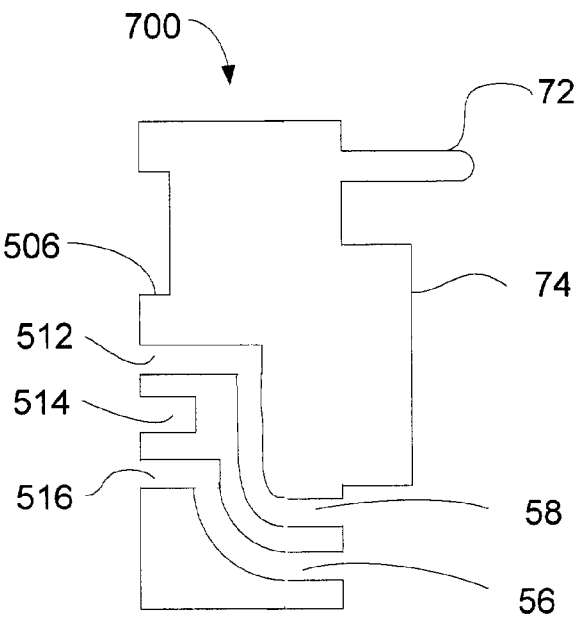
FIG. 3B depicts the adapter of FIG. 2B aligned to FIG. 3A.
Figure 3A:
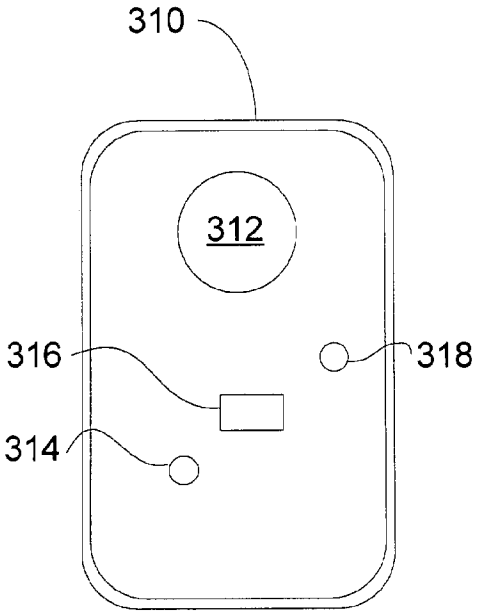
FIG. 3A depicts a plan view of an embodiment of a backplate of a retrofit tool.

Referring to FIG. 3A-C, the plan view of the backplate 310 (FIG. 3A) of a retrofit tool 11 comprises a compressible fluid supply port 314 which couples with adapter 700 (FIG. 3B) port 516 to channel compressible fluid through adapter port 56 to compressible fluid inlet port 250 of the modular control apparatus 600 (FIG. 3C). Backplate 310 further comprises a motor inlet port 318, which receives compressible fluid from adapter port 512 that has been channeled through adapter port 58 from the discharge port 252 of the modular control apparatus 600. Backplate 310 further comprises alignment features 312 and 316, which fit in only one orientation with alignment features 506 and 514 on adapter 700. Likewise, alignment features 72 and 74 of adapter 700 fit in only one orientation with alignment features 76 and 78 of modular control apparatus 600.

A retrofit kit for an embodiment of FIGS. 3A–C comprises an adapter 700, a modular control apparatus 600, and fasteners and couplings (not shown). In a particular embodiment, the retrofit kit may include at least one instruction sheet describing and illustrating the methods of using the retrofit kit. In other particular embodiments, the adapter 700 may be fixedly attached to the modular control apparatus 600, wherein the combined adapter 700 and modular control apparatus 600 are releasably attached as a unit to the retrofit tool 11.

Refer to FIG. 4. A second approach to adapting a modular control apparatus 600 to a retrofit tool 11 involves inserting an adapter 900 between the top of the handle 12 and the motor 14. A modular control apparatus 600 for a pneumatic power impact retrofit tool 11 must have access to the compressed air supply line 50 to the air motor 14, in order to re-channel the compressed air through the modular control apparatus 600. For some retrofit tools 11, the compressed air supply line 50 may be intercepted between the handle 12 and the air motor 14. Pneumatic tools are conventionally constructed by attaching an air motor 14 to a handle 12 with an air supply valve 60 (FIG. 1) and adding a housing 16. For such retrofit tools 11, a portion of an adapter 900 may be fit between the air motor 14 and the handle 12. If the trigger valve 62 is modular, it may have a coupling that can be exploited. Likewise, any coupling on the motor 14 inlet should be exploited by adapter 900. Adapter 900 receives the compressible fluid flow from handle channel 50 into adapter channel 910, which channels the compressible fluid flow into modular control apparatus 600 inlet port 250. The modular control apparatus 600 channels its output compressible fluid through port 252 and into adapter channel 908. Adapter channel 908 conducts the compressible fluid to the motor 14. Fastener 950 helps to secure the modular control apparatus 600 to the retrofit tool. Depending on the configuration of retrofit tool 11, the adapter kit may need to include a new housing 16 or sections thereof sections to replace the original one, which may no longer fit after an adapter 900 is inserted between the handle 12 and the air motor 14.

A retrofit kit for an embodiment intercepting the compressible fluid flow between the handle 12 and the motor 14 may comprise a modular control apparatus 600, an adapter configured to fit between the handle 12 and the motor 14 and to conduct compressible fluid to and from the modular control apparatus 600, and fasteners and couplings.

Figure 5:
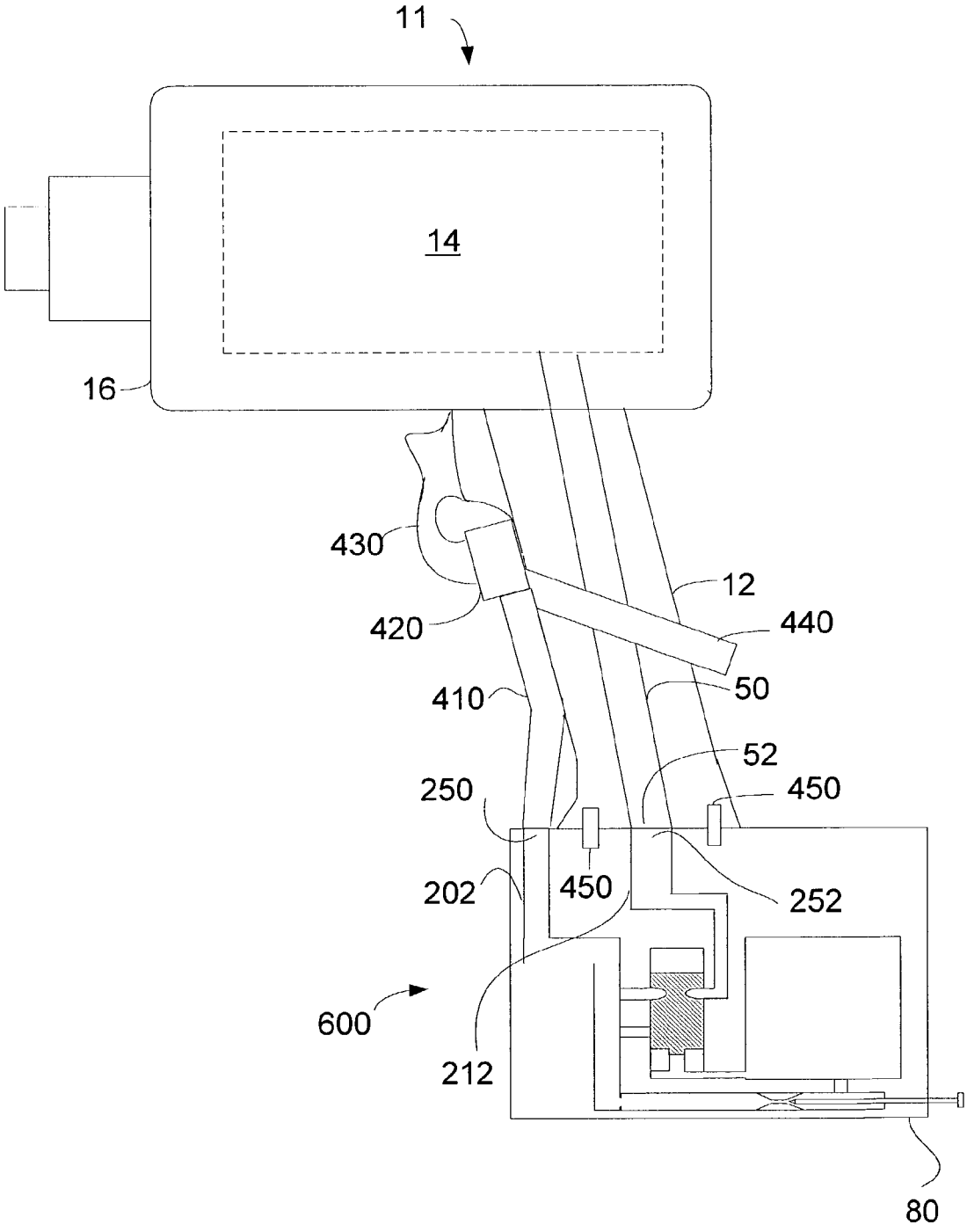
FIG. 5 shows an example of an embodiment of a modular control apparatus specially adapted to intercept the flow of energy outside of the tool.

Refer to FIG. 5. A third approach to adapting a modular control apparatus 610 to a retrofit tool 11 involves intercepting the compressible fluid supply before it ever enters the retrofit tool 11. Adapted modular control apparatus 610 may be a modified version of modular control apparatus 600, wherein the modifications adapt the modular control apparatus to the tool without a separate adapter. The adapted modular control apparatus 610 may be releasably attached to the base of the handle 12. In an alternate embodiment, adapted modular control apparatus 610 may be attached behind the motor 14. In a particular embodiment, the compressible fluid supply hose 440 that normally connects at coupling 54 (FIG. 1) may be connected to port 250 with a coupling, and port 252 may be connected to coupling 54 (FIG. 1) with a hose and a coupling. In such retrofit cases, a trigger valve 420 may be needed between the air supply hose 440 and the adapted modular control apparatus 610. Thus, a particular embodiment of a retrofit kit for a retrofit tool 11 comprises an adapted modular control apparatus 610 with a trigger valve 420 upstream of port 250, a modified trigger mechanism 430, attachment hardware 450, a hose 410 or similar channel for connecting compressible fluid from the trigger valve 420 to port 250 of the modular control apparatus 610, and a seal or coupling connecting port 252 to port 52. In such an embodiment, trigger valve 60 (FIG. 1) would be locked open or removed to allow the retrofit trigger valve 420 to control operation of the retrofit tool 11.

A retrofit kit for the embodiment of FIG. 4 may comprise a adapted modular control apparatus 610, trigger valve 420, trigger 430, channels 440 and 410, fasteners 450, and couplings (not shown).

Figure 6:
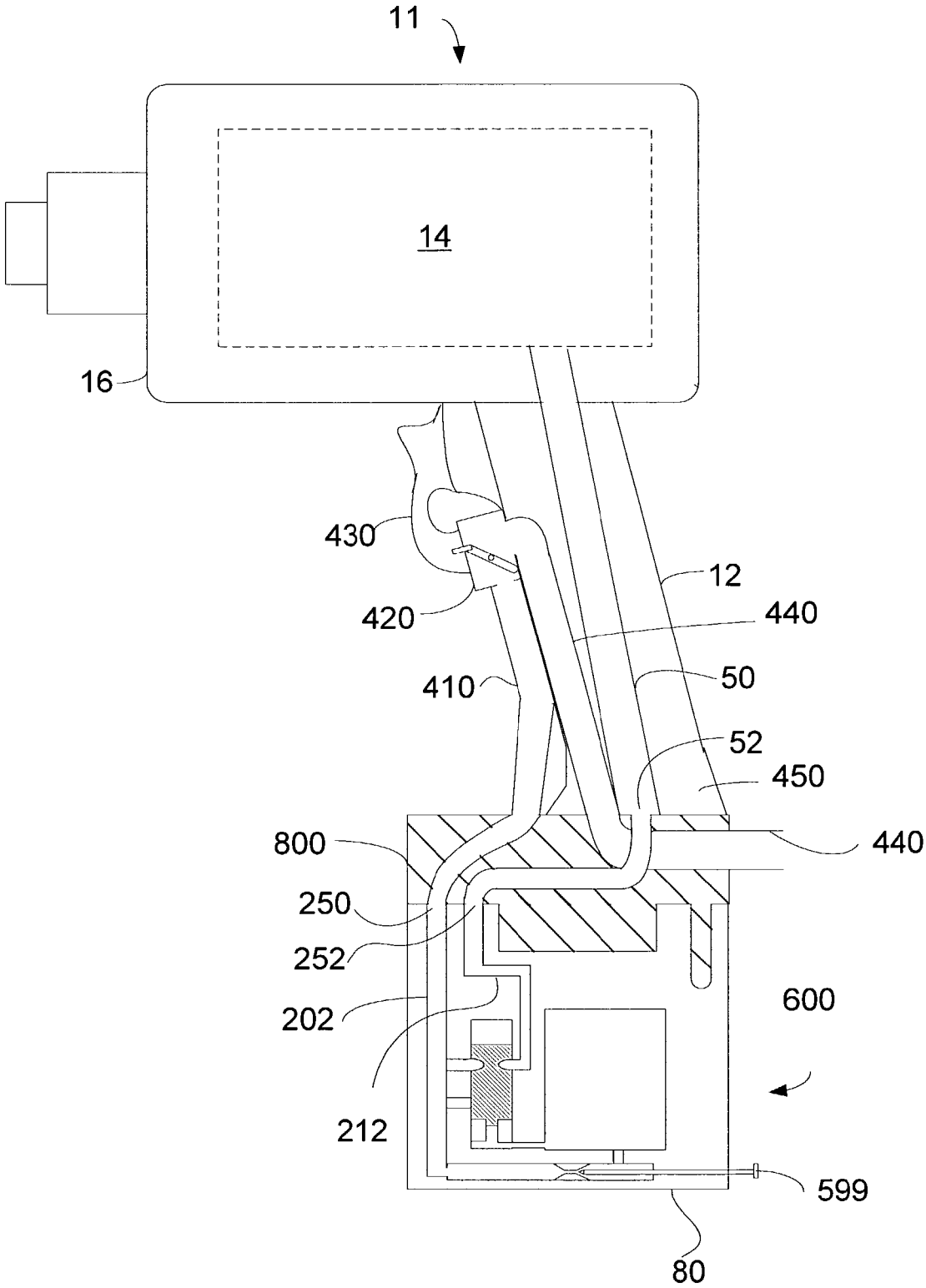
FIG. 6 shows an example of an embodiment of a modular control apparatus connected to an adapter specially adapted to intercept the flow of energy outside of the tool.
Figure 1B:
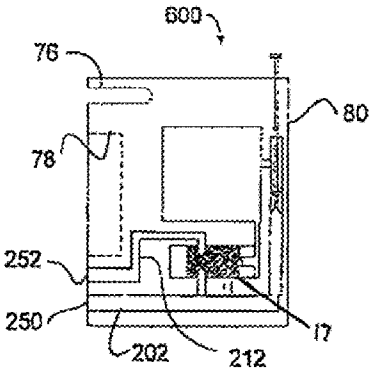
Figure 1A:
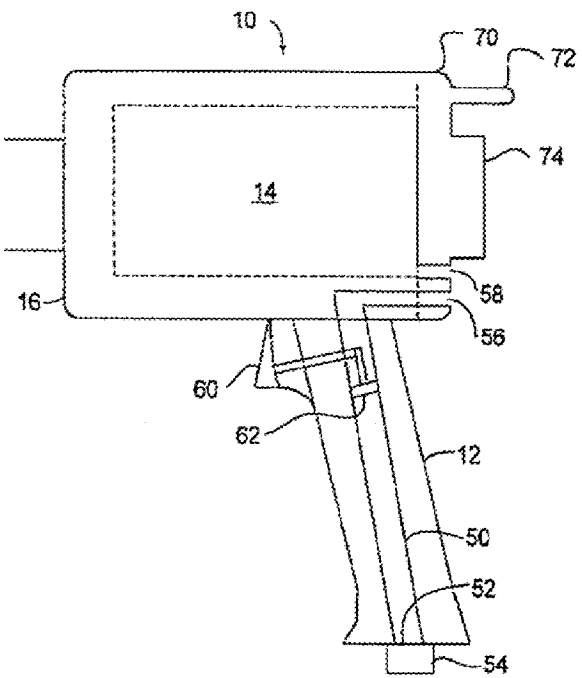

Refer to FIG. 6. In some embodiments, an adapter 800 is placed between the base of the handle 12 and the modular control apparatus 600. The adapter 800 may, in addition to making the necessary fluidic connections, position the modular control apparatus 600 to provide a retrofit tool 11 with a desirable balance and grip. Compressible fluid supply line 440 enters adapter 800 at any convenient point and runs to the trigger valve 420. The compressible fluid supply line 440 may be disposed inside or outside of the handle 12. Trigger valve 420 is actuated to open by squeezing trigger 430. When trigger valve 420 is open, compressible fluid flows through channel 410, through the adapter, and into the inlet port 250 of the modular control apparatus 600. Compressible fluid leaving the modular control apparatus 600 through port 252 is channeled through the adapter to port 52 in the handle 12 of the retrofit tool 11. The compressible fluid then moves through channel 50 to motor 14.

In a particular embodiment, the original valve 60 (FIG. 1) is used, and the flow is intercepted just downstream of the valve, channeled through the handle 12 and an adapter 800 to the inlet port 250 of the modular control apparatus 600, and returned from port 252 in the modular control apparatus 600 to the motor 14 via the adapter and a new channel 410 in the handle 12. Those of skill in the art will recognize that, once a choice has been made to intercept the supply of compressible fluid before it reaches the retrofit tool 11, the modular control apparatus 600 may be attached to any point on the tool 11 that does not interfere with operating the tool 11.

In a particular embodiment, the adapter 800 may be configured to provide access to the manual control element 599 on the modular control apparatus 600 to a hand which is gripping the tool 11. For example, in FIG. 6, if the modular control apparatus 600 was reoriented so that manual control element was just below the trigger valve 420, the operator may manipulate the manual control element 599 with one finger of the hand gripping the tool 11.

A retrofit kit for an embodiment shown in FIG. 6 may include a modular control apparatus 600, an adapter 800, channels 410 and 440 for compressible fluid flow, a trigger valve 420, a trigger 430, and couplings and fasteners (not shown).

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. A retrofit kit for retrofitting a modular control apparatus to a pneumatic impact tool, the tool having a handle, a housing, and a motor, the kit comprising:

an adapter, said adapter including, channels, operative to direct energy used to power a tool motor to and from the modular control apparatus and from an energy supply to the tool, respectively, wherein the channels have ports surfaces, configured to: align the adapter and the modular control apparatus to the tool and contain ports, the ports configured to at least one of receive and discharge energy, the ports operative to couple with reciprocal ports in at least one of the tool, the modular control apparatus, and an energy supply line mechanical connections, operative to attach the adapter to the tool and to attach the adapter to the modular control apparatus and structure, the structure operative to maintain the channels, surfaces, and mechanical connections in an operative relationship;

wherein said modular control apparatus is releasably attachable to said adapter.

2. The retrofit kit of claim 1 wherein the modular control apparatus comprises a torque timing device for a pneumatic power impact tool.

3. The retrofit kit of claim 2, wherein said torque limiting timing device further comprises at least one channel having a compressible fluid flow therethrough, said flow being controlled by an automatic valve, said at least one channel further comprising an input port and a discharge port, said automatic valve further being in fluid communication with a reservoir of compressible fluid.

4. The retrofit kit of claim 1, wherein at least one mechanical connection is a releasable connection.

5. The retrofit kit of claim 1, wherein the energy comprises energy in a compressed fluid.

6. The retrofit kit of claim 1, wherein to adapter is configured to orient the modular control apparatus to place a manual control element of the modular control apparatus within reach of at least one finger of the hand grasping the tool by a tool handle during tool operation.

7. The retrofit kit of claim 6, wherein the modular control apparatus comprises a torque-timing device.

8. The retrofit kit of claim 1, wherein the adapter is configured to attach to a backplate of the tool.

9. The retrofit kit of claim 1, wherein the adapter is configured to intercept, in a space between the handle and the motor, a flow of energy to the tool.

10. The retrofit kit of claim 1, further comprising housing panels, the housing panels adaptive to accommodate the adapter.

11. The retrofit kit of claim 1, wherein the adapter is configured to intercept, at a point outside the tool, a flow of energy to the tool.

12. The retrofit kit of claim 1, further comprising at least one fastener.

13. A retrofit kit for retrofitting a modular control apparatus to a pneumatic impact tool, the tool having a handle and a motor, the kit comprising an adapter having channels operative to energy used to power a tool motor to and from the modular control apparatus and from an energy supply to the tool, respectively, wherein the channels have ports, wherein said a modular control apparatus tat includes a torque limiting timing device.

* * * * *

UNITED STATES PATENT AND TRADEMARK OFFICE

CERTIFICATE OF CORRECTION

PATENT NO. : 6,988,565 B2
APPLICATION NO. :10/191328
DATED : January 24, 2006
INVENTOR(S) : Giardino It is certified that error appears in the above-identified patent and that said Letters Patent is hereby corrected as shown below:

On The Title Page, Item -56-
Line 4, delete "3,703,993" and insert -- 3,703,933 --

Column 3
Line 23, delete "my"

Column 8
Line 45, insert a semicolon after "ports"
Line 47, insert a semicolon after "tool"
Line 51, insert a semicolon after "line"
Line 54, insert a semicolon after "apparatus"

Column 9
Line 7, delete "to" and insert -- the --

Column 10
Line 12, delete "energy" and insert -- direct --
Line 15, delete "said a" and insert -- said --
Line 15, delete "tat"

The title page, showing an illustrative figure, should be deleted and substitute therefor the attached title page.

Delete drawing sheet 1, and substitute, therefor the drawing sheet, consisting Of Figs. 1A-Figs. 1B. As shown on the attached pages.

Signed and Sealed this

Twenty-ninth Day of January, 2008

JON W. DUDAS
*Director of the United States Patent and Trademark Office*

(12) United States Patent
Giardino

(10) Patent No.: US 6,988,565 B2
(45) Date of Patent: Jan. 24, 2006

(54) RETROFIT KIT FOR A MODULAR CONTROL APPARATUS FOR A POWER IMPACT TOOL

(75) Inventor: David A. Giardino, Rock Hill, SC (US)

(73) Assignee: Chicago Pneumatic Tool Company, Rock Hill, SC (US)

( * ) Notice: Subject to any disclaimer, the term of this patent is extended or adjusted under 35 U.S.C. 154(b) by 0 days.

(21) Appl. No.: 10/191,328

(22) Filed: Jul. 9, 2002

(65) Prior Publication Data

US 2004/0007370 A1 Jan. 15, 2004

(51) Int. Cl.
*B25D 9/00* (2006.01)
*B25B 23/14* (2006.01)

(52) U.S. Cl. ..... 173/176; 173/93; 173/168; 173/218

(58) Field of Classification Search ..... 173/176, 173/180, 178, 179, 1, 937, 138, 177, 218, 173/78, 93.5, 93, 93.7, 168, 169
See application file for complete search history.

(56) References Cited

U.S. PATENT DOCUMENTS 2,727,598 A * 12/1955 Mitchell et al. ..... 173/178
3,162,250 A * 12/1964 Siadelar ..... 173/176
3,406,762 A * 10/1968 Kramer ..... 173/176
3,578,091 A * 5/1971 States ..... 173/176
3,643,749 A * 2/1972 Pauley ..... 173/176
3,703,893 A * 11/1972 Schoeps ..... 173/178
4,562,389 A * 12/1985 Jundt et al. ..... 173/176
4,729,436 A * 3/1988 Asnofor et al. ..... 173/179
5,082,066 A * 1/1992 Schoeps ..... 173/178
5,181,575 A * 1/1993 Maruyama et al. ..... 173/180
5,315,501 A * 5/1994 Whitehouse ..... 173/183
5,492,185 A * 2/1996 Schoeps et al. ..... 173/176
5,544,710 A * 8/1996 Grosbans et al. ..... 173/176
5,715,894 A * 2/1998 Maruyama et al. ..... 173/180
6,155,355 A * 12/2000 Holmin ..... 173/176
6,378,623 B2 * 4/2002 Kawarai ..... 173/180
6,765,357 B2 * 7/2004 Cripe et al. ..... 173/176

* cited by examiner

*Primary Examiner*—Scott A. Smith
(74) *Attorney, Agent, or Firm*—Schmeiser, Olsen & Watts

(57) ABSTRACT

The invention comprises retrofit kits for power impact tools. The retrofit kits adapt modular control apparatuses to power impact tools that where not originally manufactured to receive a modular control apparatuses. The retrofit kits comprise a modular control apparatus and at least one fastener. The modular control apparatus may be specially manufactured to adapt retrofit tools or an adapter may be included in the kit. Adapters intercept the energy flow to the motor of the tool and re-channels the energy flow through a modular control apparatus, which then controls the flow of energy to the motor. The retrofit kit may include instruction sheets describing and illustrating the methods of using the retrofit kit.

13 Claims, 6 Drawing Sheets

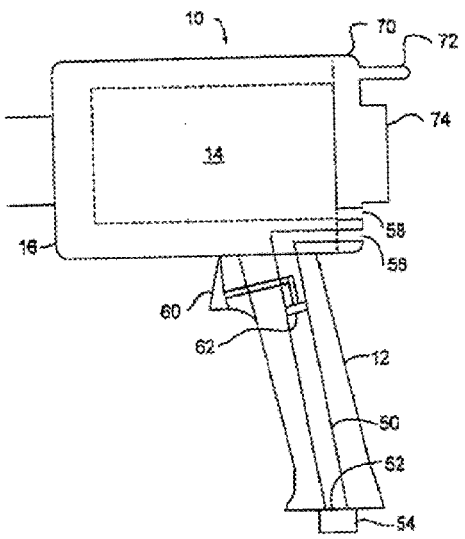

FIG. 1A

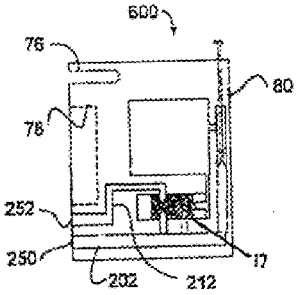

FIG. 1B